United States Patent [19]

Bedford et al.

[11] Patent Number: 4,776,113

[45] Date of Patent: Oct. 11, 1988

[54] CORNER GUARD SYSTEM HAVING A REPLACEABLE CORNER TOOTH

[75] Inventors: Billy R. Bedford, Peoria; Martin V. Kiesewetter, Morton; Gene R. Klett, Washington; William J. Renski, Peoria, all of Ill.

[73] Assignee: Caterpillar Inc., Peoria, Ill.

[21] Appl. No.: 112,987

[22] Filed: Oct. 27, 1987

[51] Int. Cl.[4] ..... E02F 9/28

[52] U.S. Cl. ..... 37/141 T; 172/701.2

[58] Field of Search ..... 37/142 R, 141 T, 141 R, 37/142 A; 172/701.2

[56] References Cited

U.S. PATENT DOCUMENTS

| | | | |
|---|---|---|---|
| 3,967,398 | 7/1976 | Stepe | 37/141 |
| 4,007,550 | 2/1977 | Stepe | 37/141 |
| 4,047,312 | 9/1977 | Stepe | 37/141 |
| 4,071,967 | 2/1978 | Klett | 37/141 |
| 4,182,057 | 1/1980 | Klett | 37/141 |

FOREIGN PATENT DOCUMENTS

| | | | |
|---|---|---|---|
| 1232760 | 5/1986 | U.S.S.R. | 37/142 R |

*Primary Examiner*—Clifford D. Crowder
*Attorney, Agent, or Firm*—J. W. Burrows

[57] ABSTRACT

A corner tooth assembly is provided on the corner of an implement for protection thereof from wear during use. It is necessary to provide a tight fit between the corner tooth and the corner portion of the implement so that unnecessary movement of the corner tooth on the corner portion is avoided while at the same time not subjecting the corner tooth to undue stresses during initial installation of the corner tooth on the implement. The present corner tooth assembly includes a corner portion integrally connected to the implement with first and second load transferring pads defined on a leading edge thereof and first and second holes defined therein and a corner tooth adapted for releasable connection to the corner portion. A trailing end portion of the corner tooth has a load transferring portion including first and second load transferring surfaces adapted when installed to mate with the first and second load transferring pads of the corner portion and a single upright side portion with first and second holes therein operative when assembled to mate with respective first and second holes of the corner portion on an implement. By having the first and second load transferring surfaces mate with the first and second load transferring pads of the corner portion and the corner tooth being secured to the corner portion by a biasing means, a tight connection is made between the corner tooth and the corner portion.

18 Claims, 2 Drawing Sheets

CORNER GUARD SYSTEM HAVING A REPLACEABLE CORNER TOOTH

TECHNICAL FIELD

This invention relates generally to a replaceable corner tooth for a corner guard system and more particularly to the structure of the replaceable corner tooth and its relationship with the implement on which it is mounted.

BACKGROUND ART

Various types of corner guard systems have been utilized in the past to protect the corner of an implement such as a loader bucket. These corner guard systems normally include a replaceable corner tooth that is expected to withstand relatively large working forces during normal operation. The releasable corner tooth may be of the unitooth type in which the portion that engages the ground and the portion that is secured to the implement are one and the same or it may be the type in which an adapter is secured to the implement while a replaceable tip is secured to the leading end of the adapter and is operative to engage the ground. Most of these designs are releasably secured to the implement by one or more bolts and have load transferring pads arranged on the replaceable corner tooth such that forces can be transmitted therethrough to the implement. It is desirable to have a simple design but to also insure that the optimum conditions are maintained in transferring the forces from the leading end of the tip into the implement itself. It is also desirable that the replaceable corner tooth be securely connected to the implement and not be allowed to move during operation. It has been found in some past designs that since the elements that form the corner of the implement are welded one to the other that it is difficult to hold reasonable tolerances between the bottom of the implement and the holes that are used to secure the corner tooth to the implement. Therefore, in this type of design, it is beneficial not to have areas on the replaceable corner tooth that transfer loads directly to the bottom of the hardened cutting edge.

Another problem that has been experienced with some of the previous designs is that in order to effectively transfer the loads from the leading edge of the tip into the implement, the replaceable corner tooth becomes very complicated and extremely difficult to manufacture by conventional forging processes. U.S. Pat. Nos. 4,007,550 issued Feb. 15, 1977 to V. A. Stepe; 4,071,967 issued Feb. 7, 1978 to G. R. Klett; and 4,182,057 issued Jan. 8, 1980 to G. R. Klett and J. A. Thies, each being assigned to the assignee of the subject invention, teach a replaceable corner tooth that provides means to transfer loads from the leading edge of the tip into the implement and further provides a means to releasably secure the adapter to the implement. However, they each suffer from common problems. More specifically, each of the corner adapters have an outside vertical portion and an inner strap that interact to sandwich a portion of the corner of the implement and must be secured by a bolt or other fastening means. Consequently, during assembly it is necessary for the bolt to be securely tightened in an attempt to insure that the member does not move with respect to the corner of the implement. Since a two strap design is utilized in the above-noted patents, it is necessary, because of loose tolerances, to provide sufficient clearance between the straps so that the corner tooth fits the implement corner under the worst tolerance conditions. The double strap design, with the required clearance, leaves a gap between the sides of the straps and the implement corner sandwiched therebetween. In order to provide a tight connection between the corner tooth and the implement corner, the gap has to be tightly closed by the fastening means (bolt). Many times the torque normally needed for a tight connection is partially or fully used to close the gap thus a "loose" connection results. Consequently, during normal working conditions, the corner tooth can easily move relative to the implement corner thus requiring the bolt to absorb any additional loads as opposed to the additional loads being shared by the bolt and the joint connection. The resulting "loose" connection causes wear in the load transfer pads and creates a lever action that works against the inside strap causing the strap to break. In the situations where the connection appears tight but is not tight due to the large amount of tightening torque used just to close the gap, additional tensile force applied to the bolt under operation may cause the bolt to stretch or yield thus again causing a "loose" connection. Furthermore, since the construction of these designs does not allow them to be produced by a forging process which provides stronger parts, it is normally necessary to produce them by a casting process.

U.S. Pat. No. 3,967,398 issued July 6, 1976 to V. A. Stepe and assigned to the assignee of the subject invention illustrates a replaceable corner tooth that is bolted to the corner portion of the implement by only one side portion of the replaceable corner tooth but suffers from the problem that the construction of this design makes it practically impossible to produce by normal forging processes. Furthermore, the load transferring characteristics of this design are primarily introduced into the bolts without having additional load transferring means to carry either tensile or shear forces on the bolts.

U.S. Pat. No. 4,047,312 issued Sept. 13, 1977 to V. A. Stepe and assigned to the assignee of the subject invention illustrates a design that is bolted both to the side of the implement and also to the bottom portion of the implement. This design also proves to be more difficult to manufacture and creates more of a problem to mate with the corner of the bucket when the components of the bucket corner are welded one to the other. The tolerances on the corner of the bucket are much more difficult to maintain when the components of the bucket corner are welded together.

The present invention is directed to overcoming one or more of the problems as set forth above.

DISCLOSURE OF THE INVENTION

In one aspect of the present invention, a replaceable corner tooth assembly is provided and is adapted for use on an implement having a normal forward longitudinal direction of working movement, an upright sidewall member and a laterally disposed cutting edge connected to the upright sidewall member. The replaceable corner tooth assembly includes a corner portion adaptable for use as an integral member of the implement and at least a portion thereof being generally vertically oriented on the upright sidewall member of the implement. The corner portion has a leading edge, first and second load transferring pads defined on the leading edge and first and second holes defined therein. The assembly further includes a corner tooth having a leading end portion operative to engage the work and a trailing end portion integrally connected to the leading end portion and adapted for releasable connection to the corner portion. The trailing end portion has a bottom end portion, a single upright side portion connected to the bottom portion on one side thereof and has first and second holes defined therein operatively aligned when assembled with the first and second holes of the corner portion, a forward portion connected to the bottom portion and to the upright side portion to define a cavity therebetween which opens in a direction away from both the leading end portion and the upright side portion, and a load transferring portion which includes first and second load transferring surfaces defined on the forward portion and operative to mate with the respective first and second load transferring pads of the corner portion.

In another aspect of the invention, a corner tooth is provided and adapted for use on an implement. The corner tooth includes a leading end portion operative to engage the work and a trailing end portion connected to the leading end portion and adapted for connecting the corner tooth to the implement when installed thereon. The trailing end portion also has a bottom portion, a single upright side portion connected to the bottom portion on one side thereof and has first and second holes defined therein, and a forward portion connected to the bottom portion and the upright side portion to define a cavity therebetween which opens away from both the leading end portion and the upright side portion. The forward portion defines a load transferring portion thereon and an extension of a plane that passes through the centers of the first and second holes in the single upright side portion passes through the load transferring portion of the forward portion.

The problem of maintaining a tight fit between the replaceable corner tooth assembly and the implement while still maintaining an effective load transferring relationship between the replaceable corner tooth assembly and the implement is overcome by this subject invention since the single upright side portion of the corner tooth is secured to the upright side member of the implement by two bolts and does not require two side straps to sandwich the upright sidewall member therebetween. The subject replaceable corner tooth assembly provides load transferring surfaces on both the corner tooth and the upright sidewall member in such a relationship that the forces from the leading edge of the corner tooth are transferred into the implement without subjecting the bolts to unnecessary tensile or shear stresses. Furthermore, since the corner tooth is secured tightly to the implement, there is no repeated "hammering" of the corner tooth against the load transferring pads of the upright sidewall member which would normally cause deforming of the load transferring pads of the upright sidewall member.

BEST MODE FOR CARRYING OUT THE INVENTION

Figure 1:
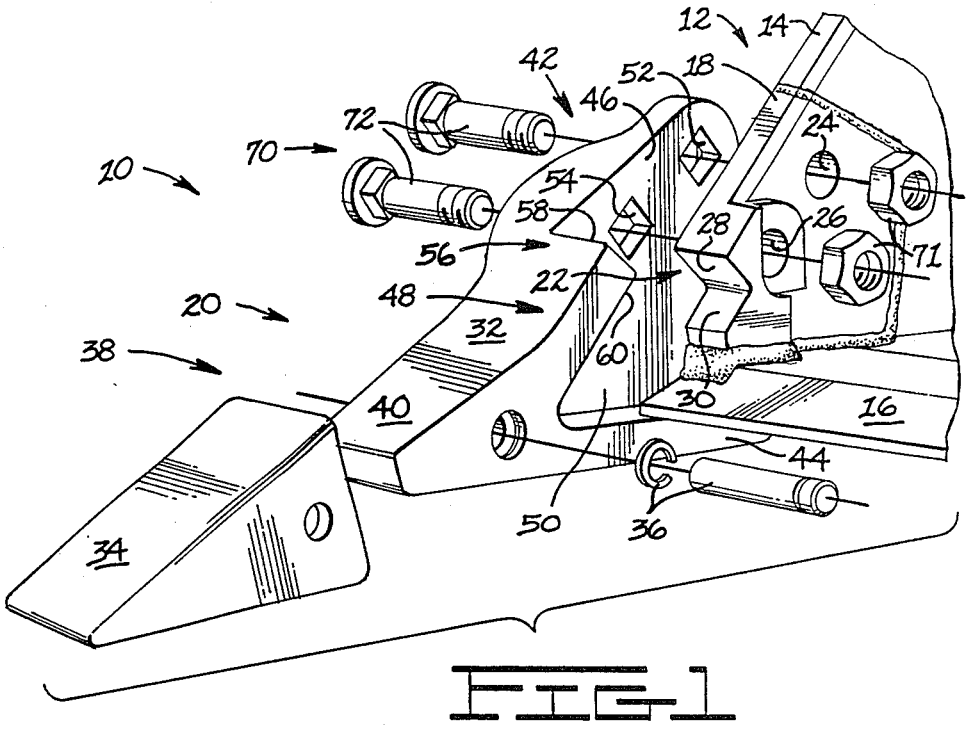
FIG. 1 is an isometric drawing representing a corner tooth assembly and a portion of a work implement incorporating an embodiment of the present invention.
Figure 2:
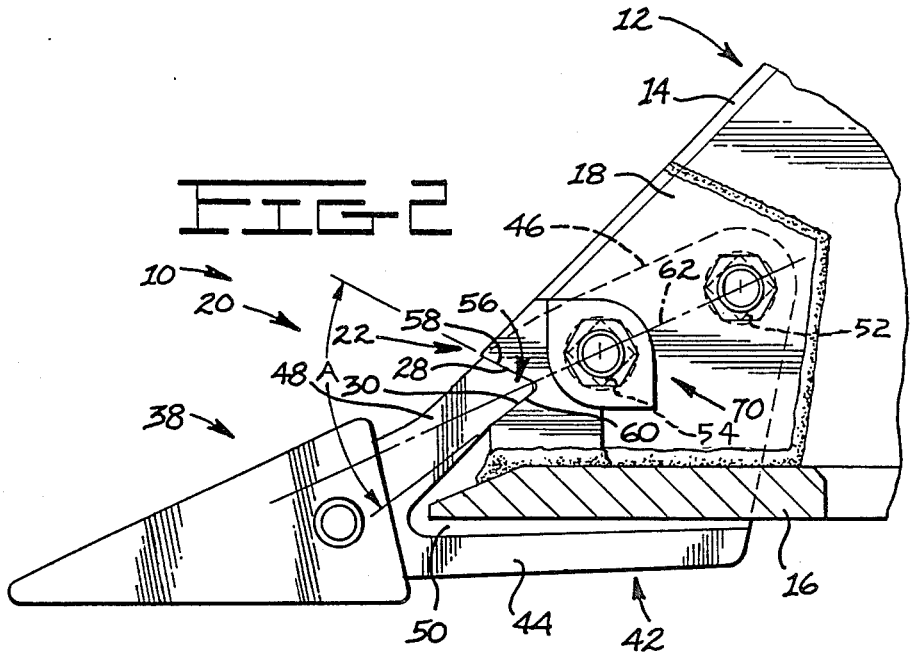
FIG. 2 is a side view of a portion of FIG. 1 further illustrating the relationship of a portion of the corner tooth assembly with respect to the implement.
Figure 3:
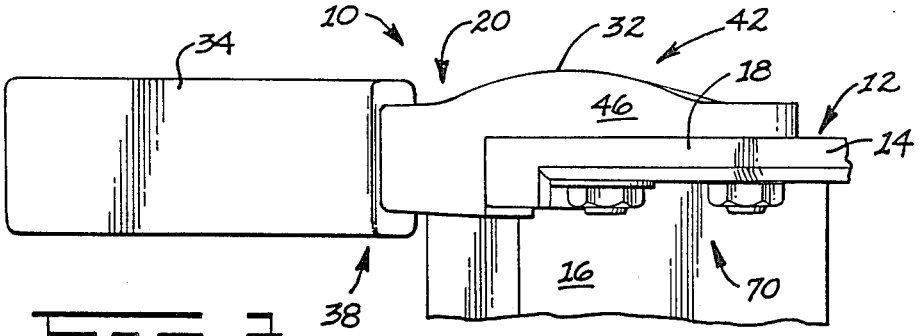
FIG. 3 is a top view of the assembly shown in FIGS. 1 and 2 illustrating the relationship between the corner tooth assembly and the implement.

Referring now to the drawings, and more particularly to FIGS. 1–3, a replaceable corner tooth assembly 10 is shown for use on an implement 12, which only a portion thereof is shown, having a normal forward longitudinal direction of working movement. The implement 12 has an upright sidewall member 14 and a laterally disposed cutting edge 16 connected to the upright sidewall member 14.

The corner tooth assembly 10 includes a corner portion 18 and a corner tooth 20. As clearly shown in FIGS. 1 and 2, the corner portion 18 is an integral member of the upright sidewall member 14 of the implement 12 and is secured thereto by welding. However, it is recognized that the corner portion 18 and the upright sidewall member 14 could be one piece but preferably the corner portion 18 is a separate member that is welded to the upright sidewall member 14. The corner portion 18 is generally vertically oriented on the upright sidewall member 14 of the implement 12 as clearly shown in FIGS. 1 and 2. The corner portion 18 has a leading edge 22, first and second holes 24,26 defined therein, and first and second load transferring pads 28,30 defined on the leading edge 22. An acute angle is formed, as shown in FIG. 2, at the juncture of the load transferring pads 28,30.

The corner tooth 20, as clearly shown in FIG. 1 includes an adapter 32, a replaceable tip 34, and a retaining assembly 36. The corner tooth 20 has a leading end portion 38 that is operative to engage the work and as illustrated in FIG. 1 includes the replaceable tip 34 and a nose portion 40 of the adapter 32. The corner tooth 20 further includes a trailing end portion 42 integrally formed with at least part of the leading end portion 38 and is adapted for releasable connection to the corner portion 18.

The trailing end portion 42 has a bottom portion 44, a single upright side portion 46 connected to the bottom portion on one side thereof, and a forward portion 48 that is connected to the bottom portion 44 and to the upright side portion 46. A cavity 50 is defined within an area encompassed by the bottom portion 44, the forward portion 48, and the upright side portion 46 and opens in a direction away from both the leading end portion 38 and the upright side portion 46. First and second holes 52,54 are defined in the single upright side portion. The trailing end portion 42 also includes a load transferring portion 56 defined on the forward portion 48. The load transferring portion 56 includes first and second load transferring surfaces 58,60 which are operative to mate with the respective first and second load transferring pads 28,30 of the corner portion 18 that is secured to the upright sidewall member 14. An acute angle "A" is formed, as shown in FIG. 2, at the juncture of the load transferring surfaces 58,60 and has an acute angle equal in size to the acute angle formed by the juncture of the load transferring pads 28,30.

As clearly shown in FIG. 2, the load transferring portion 56 is spaced from the bottom portion 44 of the corner tooth 20 so that when assembled the bottom portion 44 is free from enagement with any portion of the implement 12. A plane 62 that passes through the centers of the first and second holes 52,54 of the single upright side portion 46 also passes through the load transferring portion 56 and the leading end portion 38.

Figure 4:
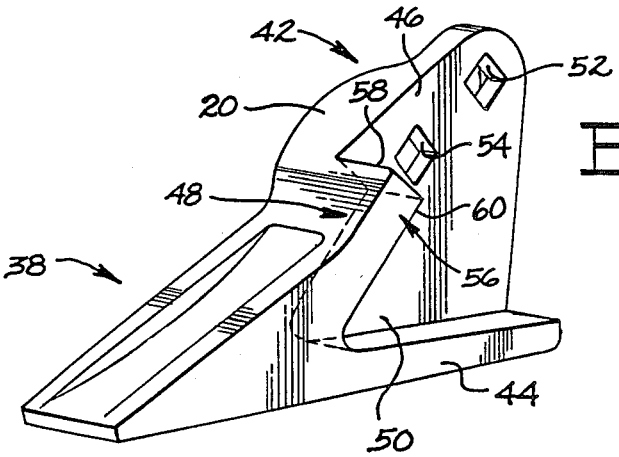
FIG. 4 is an isometric view of a corner tooth assembly incorporating another embodiment of the present invention.

Referring to FIG. 4, the corner tooth 20 is shown and differs from the corner tooth 20 shown in FIGS. 1-3 only in that the corner tooth 20 of FIG. 4 is of a "unitooth" design. In this arrangement, the leading end portion 38 is of a one-piece design as opposed to having the replaceable tip 34 and the nose portion 40 as illustrated in FIGS. 1-3. All other features of the trailing end portion 42 of the corner tooth 20, illustrated in FIG. 4, are the same as those set forth above for the corner tooth 20 illustrated in FIGS. 1-3.

Figure 5:
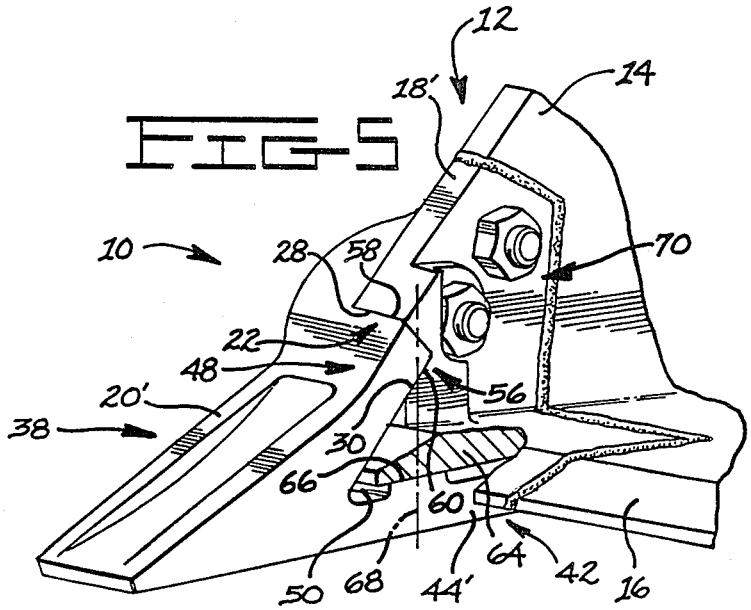
FIG. 5 is an isometric drawing representing a corner tooth assembly on an implement incorporating yet another embodiment of the present invention.

Referring to FIG. 5, an alternate embodiment of the corner tooth assembly 10 is illustrated. In this embodiment, like elements will be illustrated by like numerals and modified elements are illustrated by like numerals with prime attached thereto. A corner portion 18' as clearly illustrated in FIG. 5 is L-shaped and includes a bottom portion 64 formed as an integral part of the corner portion 18'. When viewing the corner portion 18 of FIG. 1 and the corner portion 18' of FIG. 5, it is clear that the only difference therebetween is that the corner portion 18' of FIG. 5 is a unitary L-shaped member that has no weld joints forming the "L" and that the corner portion 18 of FIG. 1 is welded at its bottom to the cutting edge 16.

The corner tooth 20', of FIG. 5, is of the unitooth construction but it is recognized that it could be a two-piece design including an adapter with a replaceable tip as illustrated in FIG. 1 without departing from the essence of the invention. The corner tooth 20' is generally the same as the corner tooth 20 illustrated in FIG. 4 except the unitooth 20' of FIG. 5 also includes an additional load transferring surface 66. The additional load transferring surface 66 is defined on the bottom portion 44 within the cavity 50 and is adapted to have load bearing contact with the bottom of the corner portion 18'. The additional load transferring surface 66 is located within the cavity 50 with respect to the load transferring portion 56 by a plane 68 that is perpendicular to the bottom portion 44 and that intersects at least a part of both the load transferring portion 56 and the additional load transferring surface 66. All other features of the corner tooth 20' are the same as those set forth with respect to the preceding figures.

As clearly illustrated in FIGS. 1, 2, 3 and 5, the corner tooth 20/20' is secured to the corner portion 18/18' by biasing means 70, such as nuts 71 and bolts 72.

INDUSTRIAL APPLICABILITY

Working forces acting on the leading end portion 38 of the corner tooth 20 may generally be divided into three categories. One being the forces acting on the corner tooth 20 generally parallel with but in opposite direction of the line of action of the implement 12. The second one being the vertical forces acting on the corner tooth 20 trying to force the tip up or down with respect to the implement. The third being the lateral force that is trying to move the corner tooth 20 to one side or the other with respect to the implement. Therefore, the corner tooth 20 must be able to overcome each of these forces while still being simple enough in construction to make the manufacturing thereof simple and economical to make.

With particular reference to the corner tooth 20 illustrated in FIGS. 1-4, the single upright side portion 46 is positively secured to the corner portion 18 by the nuts and bolts 71,72. This connection insures a tight fit between the corner tooth 20 and the corner portion 18 so that the physical connection between the parts absorbs the forces instead of the forces being absorbed only by the bolts 72. Additionally, the engagement of the first and second load transferring surfaces 58,60 with the first and second load transferring pads 28,30 provides a mechanism to transfer various loads from the leading end portion 38 directly to the implement 12 through the corner portion 18. All generally horizontal forces subjected to the leading end portion 38 are transferred to the implement 12 through the load transferring portion 56 and the first and second load transferring pads 28,30 while vertical forces acting upwardly are transferred to the first load transferring pad 28 by the first load transferring surface 58 and any vertical forces acting downwardly are transmitted to the second load transferring pad 30 by the second load transferring surface 60. This transferring of forces from the first and second load transferring surfaces 58,60 to the first and second load transferring pads 28,30 is more effectively transferred in view of the fact that the line of action of the forces is directed through a plane that intersects the load transferring portion 56 and the centers of the first and second holes 52,54 of the corner tooth 20. Furthermore, the load transferring abilities of the subject invention is enhanced if an extension of the plane 62 would also generally intersect at least a portion of the leading end portion 38.

In order to insure a proper fit-up between the corner tooth 20 and the upright sidewall member 14, the bottom portion 44 of the corner tooth 20 is spaced from the load transferring portion 56 a sufficient distance that when assembled the bottom portion 44 does not contact any portion of the implement 2. This is beneficial since the corner portion 18 is welded to the upright sidewall member 14 and the cutting edge 16. The tolerancing of welding the corner portion 18 in place and the bulkiness of the weld many times creates clearance problems and interferes with the ability of the nuts and bolts 71,72 to securely tighten the corner tooth 20 to the corner portion 18. As clearly shown in FIGS. 1 and 2, the cavity 50 provides ample clearance between any part of the implement 12 and the bottom portion 44 of the corner tooth 20.

The nuts and bolts 71,72 effectively control all lateral forces subjected to the corner tooth 20. By having a tight joint connection between the corner tooth 20 and the corner portion 18, there is no undesirable movement of the corner tooth 20 with respect to the corner portion 18, thus generally eliminating any "hammering" type of impact loads from the first and second load transferring surfaces 58,60 to the respective first and second load transferring pads 28,30. Any unnecessary hammering type impact loads tend to prematurely destroy the intimate contact between the first and second load transferring surfaces 58,60 and the first and second load transferring pads 28,30.

By having the juncture of the first and second load transferring surfaces 58,60 form the acute angle "A" and the corresponding first and second load transferring pads 28,30 of the corner portion 18 having the same acute angle formed at its juncture, any horizontal forces coupled with any vertical forces are more effectively controlled by the mate-up of the load transferring surfaces 58,60 of the corner tooth 20 with the first and second load transferring pads 28,30 of the corner portion 18.

Referring to FIG. 5, since the corner portion 18' is of an L-shaped configuration and the bottom portion of the "L" is an integral part of the corner portion 18' and does not have to be welded thereto, the concerns of the bulkiness of the weld and weld tolerances are no longer of serious consequence. Therefore, an additional load transferring pad 66 is located within the cavity 50 and when assembled is in intimate contact with the bottom portion 64 of the corner portion 18'. By having the additional load transferring surface 66 located generally under the load transferring portion 56 of the corner tooth 20', any and all upwardly induced vertical forces may be more effectively controlled without making the corner tooth 20 more complicated to make.

The replaceable corner tooth assembly 10, as set forth above, provides a corner system that insures the corner tooth 20/20' to be tightly fitted to the corner portion 18/18'. It also provides a load transferring portion 56 on the corner tooth that mates with the corresponding pads 28,30 on the corner portion 18/18'. This mate-up effectively transfers the loads from the leading end portion 38 directly into the implement 12 while keeping the corner tooth 20/20' simple to manufacture and more economical to produce. By insuring a tight fit between the corner tooth 20/20' and the corner portion 18/18', less stresses are induced into the corner tooth and premature breakage of the corner tooth during use is substantially eliminated.

Other aspects, objects and advantages of this invention can be obtained from a study of the drawings, the disclosure and the appended claims.

We claim:

1. A releasable corner tooth assembly adapted for use on an implement having a normal forward longitudinal direction of working movement, an upright sidewall member and a laterally disposed cutting edge connected to the upright sidewall member, comprising:

a corner portion adaptable for use as an integral member of the implement and at least a portion thereof generally vertically oriented on the upright sidewall member of the implement, said corner portion having a leading edge, first and second load transferring pads defined on the leading edge thereof, and first and second holes defined therein; and a corner tooth having a leading end portion operative to engage the work and a trailing end portion integrally connected to the leading end portion and adapted for releasable connection to said corner portion, said trailing end portion having a bottom portion, a single upright side portion connected to the bottom portion on one side thereof and having first and second holes defined therein operatively aligned when assembled, with the first and second holes of the corner portion, a forward portion connected to the bottom portion and to the single upright side portion to define a cavity therebetween which opens in a direction away from both the leading end portion and the single upright side portion, and a load transferring portion which includes first and second load transferring surfaces defined on the forward portion and operative to mate with the respective first and second load transferring pads of the corner portion, said first and second load transferring surfaces are spaced from the bottom portion of the corner tooth.

2. The replaceable corner tooth assembly, as set forth in claim 1, wherein when assembled the bottom portion of the corner tooth is free from engagement with any portion of the implement.

3. The replaceable corner tooth assembly, as set forth in claim 2, wherein an extension of a plane that passes through the centers of the first and second holes in the single upright side portion passes through the load transferring portion (56).

4. The replaceable corner tooth assembly (10), as set forth in claim 3, wherein an acute angle is formed by the juncture of the first and second load transferring surfaces of the corner tooth.

5. The replaceable corner tooth assembly, as set forth in claim 4, wherein the extension of the plane that passes through the centers of the first and second holes of the single upright side portion also passes through the leading end portion of the corner tooth.

6. The replaceable corner tooth assembly, as set forth in claim 5, wherein the corner tooth includes a corner adapter and a replaceable tip.

7. The replaceable corner tooth assembly, as set forth in claim 1, wherein the corner portion includes a bottom portion which is integrally formed therewith and the trailing end portion of the corner tooth has an additional load transferring surface defined on the bottom portion of the corner tooth within the cavity and adapted for load bearing contact with the bottom portion of the corner portion.

8. The replaceable corner tooth assembly, as set forth in claim 7, wherein an extension of a plane that passes through the centers of the first and second holes in the single upright side portion passes through the load transferring portion of the forward portion of the corner tooth.

9. The replaceable corner tooth assembly, as set forth in claim 8, wherein an acute angle is formed by the juncture of the first and second load transferring surfaces of the corner tooth.

10. The replaceable corner tooth assembly, as set forth in claim 9, wherein the corner tooth includes a corner adapter and a replaceable tip.

11. A corner tooth adapted for use on an implement comprising:

a leading end portion operative to engage the work; and a trailing end portion connected to the leading end portion and adapted for connecting the corner tooth to the implement when installed thereon, said trailing end portion having a bottom portion, a single upright side portion connected to the bottom portion on one side thereof and having first and second holes defined therein, and a forward portion connected to the bottom portion and the single upright side portion to define a cavity therebetween which opens away from both the leading end portion and the single upright side portion, said forward portion defining a load transferring portion located thereon, and an extension of a plane that passes through the centers of the first and second holes in the single upright side portion passes through the load transferring portion of the forward portion.

12. The corner tooth, as set forth in claim 11, wherein the load transferring portion has first and second load transferring surfaces.

13. The corner tooth, as set forth in claim 12, wherein the juncture of the first and second load transferring surfaces forms an acute angle.

14. The corner tooth, as set forth in claim 13, wherein the extension of the plane that passes through the centers of the first and second holes in the single upright side portion also passes through the leading end portion.

15. The corner tooth, as set forth in claim 14, wherein the corner tooth includes a corner adapter and a replaceable tip.

16. The corner tooth, as set forth in claim 11, including an additional load transferring surface defined on the bottom portion within the cavity and located with respect to the load transferring portion by a plane that is perpendicular to the bottom portion and the additional load transferring surface.

17. The corner tooth, as set forth in claim 16, wherein the load transferring portion includes first and second load transferring surfaces defined thereon.

18. The corner tooth, as set forth in claim 17, wherein an acute angle is formed at the juncture of the first and second load transferring surfaces.

* * * * *